US007275522B2

(12) United States Patent
Beilharz et al.

(10) Patent No.: US 7,275,522 B2
(45) Date of Patent: Oct. 2, 2007

(54) METHOD AND APPARATUS FOR CONTROLLING A VALVE, AND METHOD AND APPARATUS FOR CONTROLLING A PUMP-NOZZLE APPARATUS WITH THE VALVE

(75) Inventors: Jörg Beilharz, Berlin (DE); Maximilian Kronberger, Regensburg (DE); Richard Pirkl, Regensburg (DE); Christian Ribler, Berlin (DE); Harald Schmidt, Vienna (AT); Hans-Jörg Wiehoff, Regensburg (DE)

(73) Assignee: Siemens AG, Munich (DE)

( * ) Notice: Subject to any disclaimer, the term of this patent is extended or adjusted under 35 U.S.C. 154(b) by 30 days.

(21) Appl. No.: 11/453,723

(22) Filed: Jun. 15, 2006

(65) Prior Publication Data

US 2006/0289670 A1 Dec. 28, 2006

Related U.S. Application Data

(63) Continuation of application No. PCT/EP2004/014271, filed on Dec. 15, 2004.

(30) Foreign Application Priority Data

Dec. 18, 2003 (DE) ..... 103 59 675

(51) Int. Cl.
*F02D 41/20* (2006.01)
*F02M 57/02* (2006.01)

(52) U.S. Cl. ..... 123/490; 310/317

(58) Field of Classification Search ..... 123/490, 123/494, 478; 310/317
See application file for complete search history.

(56) References Cited

U.S. PATENT DOCUMENTS 6,102,008 A * 8/2000 Maeda et al. ..... 123/490
6,240,905 B1 * 6/2001 Boecking ..... 123/498

(Continued)

FOREIGN PATENT DOCUMENTS

CA 2292518 12/1998

(Continued)

OTHER PUBLICATIONS

International Search Report for International Application No. PCT/EP2004/014271 (5 pages).

(Continued)

*Primary Examiner*—Stephen K. Cronin
*Assistant Examiner*—Arnold Castro
(74) *Attorney, Agent, or Firm*—Baker Botts L.L.P.

(57) ABSTRACT

A valve has a piezoelectric actuator with a valve element, a valve body and a valve seat. In order to control the valve, the valve element is moved into the valve seat from a position remote from the valve seat by means of a charging process at a prescribable first time. A first value is determined being characteristic of the electrical power supplied to the piezoelectric actuator when the valve element meets the valve seat. A second value is determined being characteristic of the electrical power supplied to the piezoelectric actuator when the charging process of the piezoelectric actuator is concluded. An actual difference value between the second value and the first value is determined. A difference between a setpoint difference value and the actual difference value is supplied to a controller. An actuating signal for charging the piezoelectric actuator is determined as a function of the actuating variable.

20 Claims, 4 Drawing Sheets

U.S. PATENT DOCUMENTS

| | | | | |
|---|---|---|---|---|
| 6,491,027 | B1 * | 12/2002 | Freudenberg et al. | 123/490 |
| 6,619,268 | B2 * | 9/2003 | Rueger et al. | 123/490 |
| 6,766,791 | B2 * | 7/2004 | Bock et al. | 123/498 |
| 6,973,919 | B2 * | 12/2005 | Joos et al. | 123/478 |
| 6,978,770 | B2 * | 12/2005 | Rauznitz et al. | 123/498 |
| 2003/0218437 | A1 * | 11/2003 | Bock et al. | 318/112 |
| 2004/0108477 | A1 * | 6/2004 | Stoecklein et al. | 251/57 |

FOREIGN PATENT DOCUMENTS

| | | |
|---|---|---|
| DE | 19652801 | 6/1998 |
| DE | 19835494 | 2/2000 |
| DE | 19723932 | 10/2000 |
| DE | 10148217 | 4/2003 |
| WO | 03/081007 | 10/2003 |
| WO | 03/091559 | 11/2003 |
| WO | 03/104633 | 12/2003 |

OTHER PUBLICATIONS

Office Action for German Appln. No. 103 59 675.5-26 (3 pages).

* cited by examiner

V_INJ²

V_D_AV²
+3
Closing time
+1
EOI
Ctrl_VL

P_H

Opening pressure
MFF
End of hydraulic
delivery (FE)

t2 t3
t

METHOD AND APPARATUS FOR CONTROLLING A VALVE, AND METHOD AND APPARATUS FOR CONTROLLING A PUMP-NOZZLE APPARATUS WITH THE VALVE

CROSS-REFERENCE TO RELATED APPLICATION

This application is a continuation of co-pending International Application No. PCT/EP2004/014271, filed Dec. 15, 2004, which designates the United States, and claims priority to German application number DE 103 59 675.5 filed Dec. 18, 2003.

TECHNICAL FIELD

The invention relates to a method and an apparatus for controlling a valve. It also relates to a method and an apparatus for controlling a pump-nozzle apparatus with a valve. The valve has a valve drive, which is in the form of a piezoelectric actuator, a valve element, a valve body and a valve seat. A pump-nozzle apparatus is used, in particular, to supply fuel to a combustion chamber of a cylinder of an internal combustion engine, in particular a diesel internal combustion engine. In the case of a pump-nozzle apparatus, a pump, a control unit comprising the valve, and a nozzle unit form one physical unit. A piston of the pump is preferably driven via a camshaft of an internal combustion engine by means of a rocker arm.

BACKGROUND

The pump can be hydraulically coupled to a low-pressure fuel supply device by means of the valve. The output end of said pump is hydraulically coupled to the nozzle unit. The start of injection and the injection quantity are determined by the valve and its valve drive. The compact construction of the pump-nozzle apparatus results in a very low high-pressure volume and a high degree of hydraulic rigidity. Therefore, very high injection pressures of approximately 2000 bar are possible. This high injection pressure, in conjunction with the ability to control the start of injection and the injection quantity in an effective manner, permit a considerable reduction in emissions and at the same time low fuel consumption when using the internal combustion engines.

DE 198 35 494 C2 discloses a pump-nozzle apparatus having a pump and a valve with a valve element which controls the hydraulic coupling of a discharge space to an outlet channel. The outlet channel is hydraulically coupled to the pump and a nozzle unit. An inlet channel is provided which is hydraulically coupled to the discharge space. The valve element has an associated piezoelectric valve drive which can be used to move the valve element between two end positions. When the valve element is in a first end position, the outlet channel is hydraulically coupled to a discharge space and this, in turn, is hydraulically coupled to the inlet channel. When the valve element is in a second end position, the outlet channel is hydraulically decoupled from the discharge space and the valve element is arranged in a valve seat of the valve.

When the valve element is in the first end position, fluid is drawn from the inlet channel by the pump via the discharge space and outlet channel during a delivery stroke of the pump. During a working stroke of a piston of the pump, fluid is forced back from the pump to the inlet channel via the outlet channel and the discharge space when the valve element is in the first end position. When the valve element is in the second end position, no fluid can be forced back and the pump piston generates high pressure since the outlet channel is not hydraulically coupled to the discharge space and the inlet channel during the delivery stroke of the pump piston. When a prescribed pressure threshold is exceeded, a nozzle needle of the nozzle unit opens a nozzle of the nozzle unit and fluid is injected. The end of injection is determined by the valve element being moved to its first end position by means of the actuating drive and fluid thus flowing back to the discharge space and the inlet channel via the outlet channel, this resulting in the pressure in the pump and therefore also in the nozzle unit decreasing, which in turn leads to the nozzle unit being closed.

Low pollutant emissions from an internal combustion engine in which the pump-nozzle arrangement is arranged and precise control of the internal combustion engine mean the pump-nozzle apparatus has to meter fuel in a precise manner. This in turn means that the piezo-controlled valve of the pump-nozzle apparatus has to be driven in a manner which can be reproduced and is stable over the long term.

WO 03/081007 A1 discloses a method and an apparatus for detecting the impact time of a valve needle of a piezoelectric control valve. The piezoelectric control valve is used in a pump-nozzle unit for injecting fuel into an internal combustion engine. The impact time of the valve needle of the piezoelectric control valve of the pump-nozzle unit is determined by evaluating the piezoelectric voltage and/or the piezoelectric current.

Furthermore, WO 03/104633 A1 discloses a method and an apparatus for measuring and controlling the closing and opening times of a piezoelectric control valve, in which the period of time required for a valve needle of a control valve of a piezoelectric pump-nozzle unit to move from a first end position to a second end position is measured, with the response time of the control valve being taken into account. In this case, the period of time is determined as a function of the voltage applied to the control valve and/or of the current applied. An actuating signal which is used to move the control valve from the first end position to the second end position is also generated, with the actuating signal being generated at a time during which it is ensured that the pressure in the control valve and in the injection nozzle during the measurement process corresponds largely to the pressure in the low-pressure fuel region.

In addition, DE 196 52 801 C1 discloses a method and an apparatus for driving at least one capacitive actuating element, said capacitive actuating element being used, in particular, in a piezoelectrically operated fuel-injection valve of an internal combustion engine. The power of the actuator and/or the charge quantity of the capacitive actuating element, which is applied to the actuator for operating purposes, are/is regulated when the capacitive actuating element is being driven. The respective prespecified setpoint values are selected as a function of various operating parameters of the internal combustion engine.

SUMMARY

The object of the invention is to provide a method and an apparatus for controlling a valve, which method and apparatus ensure that the valve switches precisely over a long operating time period. A further object of the invention is to provide a method and apparatus for controlling a pump-nozzle apparatus with the valve, which method and apparatus ensure that the valve switches precisely over a long operating time period.

The invention is distinguished by a method and a corresponding apparatus for controlling a valve having a valve drive, which is in the form of a piezoelectric actuator, having a valve element, a valve body and a valve seat, in which the valve element is moved into the valve seat from a position remote from the valve seat by means of a charging process of the piezoelectric actuator at a prescribable first time, in which a first value is determined which is characteristic of the electrical power which is supplied to the piezoelectric actuator when the valve element meets the valve seat, in which a second value is determined which is characteristic of the electrical power which is supplied to the piezoelectric actuator when the charging process of the piezoelectric actuator is concluded. An actual difference value is determined from the difference between the second value and the first value. A difference between a setpoint difference value, which can be prescribed, and the actual difference value is supplied to a controller, and an actuating signal for charging the piezoelectric actuator is determined as a function of the actuating variable of the controller.

In terms of the further aspect of the invention, the invention is distinguished by a method and a corresponding apparatus for controlling a pump-nozzle apparatus, having a pump which has a piston and a working space, a control unit which comprises an outlet channel, which is hydraulically coupled to the working space, and the valve, and comprises a discharge space which is hydraulically decoupled from the outlet channel when the valve element rests against the valve seat and which is otherwise hydraulically coupled to the outlet channel. The valve is controlled using the method or the apparatus for controlling the valve.

The invention is distinguished in that the valve seating force, with which the valve drive presses the valve element into the valve seat when said valve element is in contact with the valve seat, can be set very exactly and also in a manner which can be reproduced very easily. The valve seating force is material to the tightness of the valve when the valve element is in contact with the valve seat. Therefore, the mechanical load on the valve element and also on the valve seat can be reduced in a deliberate manner over a long operating time period of the valve and at the same time it can be ensured that the valve seating force remains constant over this long operating time period. It is therefore also possible to minimize tolerances during the closing and opening processes of the valve in a simple manner. In connection with the pump-nozzle apparatus, it is therefore possible to set the start of delivery and in particular the end of delivery of the fuel in a very precise manner over a long operating time period.

The invention is based on the knowledge that the first value critically depends on a force which is created by the pressure of the fluid which acts on the valve element, and a force of a return means which is conventionally present, and that the second value critically depends on a valve seating force and also on the force which is created by the pressure of the fluid which acts on the valve element, and the force of the return means. The invention is also based on the knowledge that the actual difference value critically depends on the valve seating force, that is to say the force which is exerted by the valve element on the valve seat of the valve body. The inventive methods and apparatuses therefore allow a value which is characteristic of the valve seating force to be determined in a precise manner, this characteristic value being the actual difference value. The sealing force can be permanently set in a very precise manner by forming the difference between the setpoint difference value and the actual difference value, and supplying this difference to the controller, and determining the actuating signal for charging the piezoelectric actuator as a function of the actuating variable of the controller. According to the invention, the piezoelectric actuator is therefore simultaneously also used as a sensor in a simple manner.

In one advantageous refinement of the invention, the actuating signal for charging the piezoelectric actuator is determined as a function of a pilot control value. As a result, the valve can be driven more precisely and quickly since the controller has to compensate only for deviations from the pilot control value.

In a further advantageous refinement of the method for controlling the valve, the setpoint difference value is determined as a function of a fuel temperature and/or a rotational speed and/or the prescribable first time. As a result, the sealing force can also be precisely set in a simple manner with different operating conditions of the valve.

In a further advantageous refinement of the method for controlling the valve, the pilot control value is determined as a function of a fuel temperature and/or a rotational speed and/or the prescribable first time. As a result, the sealing force can also be precisely set in a simple manner with different operating conditions of the valve.

In a further advantageous refinement of the method for controlling the valve, the controller has a proportional component and an integral component. This has the advantage that the sealing force can be set extremely precisely in a stationary manner.

In a further advantageous refinement of the method for controlling the valve, the actual difference value is low-pass-filtered before the difference from the setpoint difference value is formed. As a result, individual measurement errors are suppressed and control therefore becomes more precise.

In a further advantageous refinement of the method for controlling the valve, the first value is an actual value of the electrical power supplied when the valve element enters the valve seat, the second value is an actual value of the electrical power supplied when the charging process is concluded, the actual difference value is an actual value of the differential electrical power which is supplied to the piezoelectric actuator, and the setpoint difference value is a setpoint value of the differential electrical power. This has the advantage that the method is very precise.

In a further advantageous refinement of the method for controlling the valve, the first value is an actual value of the piezoelectric voltage which is produced when the valve element enters the valve seat, the second value is an actual value of the piezoelectric voltage which is produced when the charging process is concluded, the actual difference value is an actual value of the differential voltage, and the setpoint difference value is a setpoint value of the differential voltage. This has the advantage that control is particularly simple.

In one advantageous refinement of the method for controlling the pump-nozzle apparatus, the prescribable first time is selected such that the piston is in its top dead center and remains there until the valve element meets the valve seat as expected, and that the actuating variable determined in this way is used to determine the actuating signal when the valve element is moved into the valve seat from a position remote from the valve seat by means of a charging process of the piezoelectric actuator at a second prescribable time, it also being possible to select the second prescribable time such that the piston has left its top dead center until the valve element meets the valve seat as expected. This has the advantage that, during the charging process of the piezoelectric actuator, the time at which the valve element actually meets the valve seat can be determined very precisely at the first time selected in this way, and the sealing force can therefore be set very precisely by means of the actuating variable of the controller, to be precise by means of the charging process of the piezoelectric actuator which is controlled starting at the second prescribable time. Therefore, fuel can be metered extremely precisely in connection with the pump-nozzle apparatus, and secondly calculation by the apparatus for control purposes following the second prescribable time can be reduced.

BRIEF DESCRIPTION OF THE DRAWINGS

Exemplary embodiments of the invention are explained below with reference to the schematic drawings, in which.

DETAILED DESCRIPTION

Figure 1:
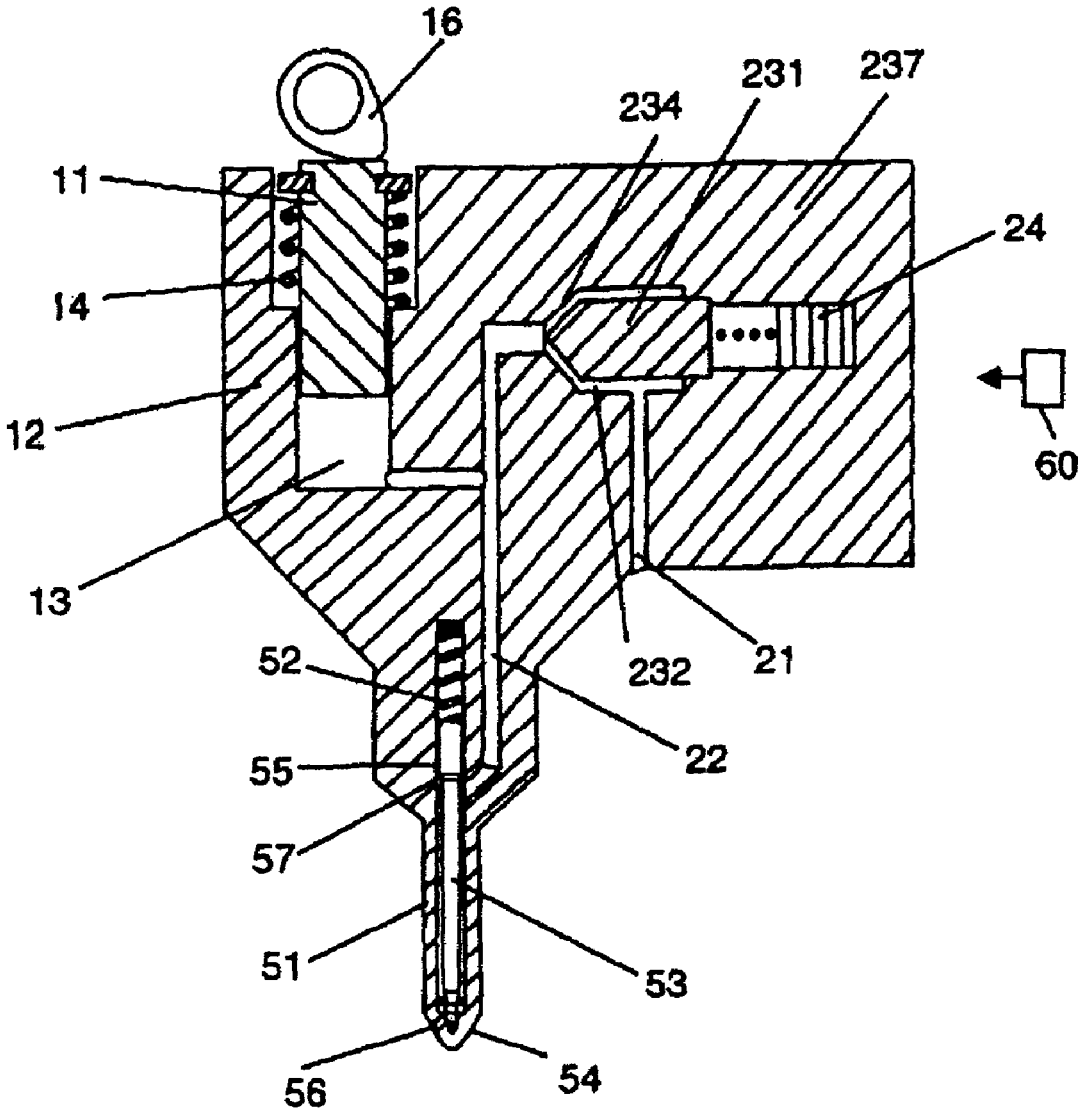
FIG. 1 shows a pump-nozzle apparatus having a valve and an apparatus for controlling the pump-nozzle apparatus and the valve.

Elements with the same design and function are identified by the same reference symbols throughout the figures.

The pump-nozzle apparatus (FIG. 1) comprises a pump unit, a control unit and a nozzle unit. The pump-nozzle apparatus is preferably used to supply fuel to the combustion chamber of a cylinder of an internal combustion engine. The internal combustion engine is preferably designed as a diesel internal combustion engine. The internal combustion engine has an intake section for taking in air, which intake section can be coupled to cylinders by means of gas-inlet valves. The internal combustion engine also has an exhaust-gas section which discharges the gases, which are to be expelled from the cylinders, in a manner controlled by the outlet valve. The cylinders each have associated pistons which are each coupled to a crankshaft by means of a connecting rod. The crankshaft is coupled to a camshaft.

The pump unit comprises a piston 11, a pump body 12, a working space 13 and a pump return means 14 which is preferably in the form of a spring. When installed in an internal combustion engine, the piston 11 is coupled to a camshaft 16, preferably by means of a rocker arm, and is driven by said camshaft. The piston 11 is guided in a recess in the pump body 12 and, as a function of its position, determines the volume of the working space 13. The pump return means 14 is formed and arranged in such a way that the volume of the working space 13 which is limited by the piston 11 has a maximum value when no external forces act on the piston 11, that is to say forces which are transmitted by means of the coupling to the camshaft 16.

The nozzle unit comprises a nozzle body 51, in which a nozzle return means 52 which is in the form of a spring and possibly additionally in the form of a damping unit, and a nozzle needle 53 are arranged. The nozzle needle 53 is arranged in a recess in the nozzle body 51 and is guided in the region of a needle guide 55.

In a first state, the nozzle needle 53 rests against a needle seat 54 and thus closes a nozzle 56 which is provided for supplying the fuel to the combustion chamber of the cylinder of the internal combustion engine. As illustrated, the nozzle unit is preferably in the form of a nozzle unit which is open toward the inside.

In a second state, the nozzle needle 53 is at a slight distance from the needle seat 54, specifically in a direction toward the nozzle return means 52, and thus opens the nozzle 56. In this second state, fuel is metered into the combustion chamber of the cylinder of the internal combustion engine.

The first or second state is assumed as a function of a balance of forces comprising the force which acts on the nozzle needle 53 by means of the nozzle return means 52, and the force which opposes this and is created by the hydraulic pressure in the region of the needle shoulder 57.

The control unit comprises an inlet channel 21 and an outlet channel 22. The inlet channel 21 and the outlet channel 22 can be hydraulically coupled by means of a valve. The inlet channel 21 is guided to the valve by a low-pressure-end connection of the pump-nozzle apparatus. The outlet channel 22 is hydraulically coupled to the working space 13 and is guided to the needle shoulder 57 and can be hydraulically coupled to the nozzle 56 as a function of the state which is assumed by the nozzle needle 53.

The valve comprises a valve element 231 which is preferably in the form of a so-called A valve, that is to say it opens toward the outside against the direction of flow of the fluid. The valve also comprises a discharge space 232 which is hydraulically coupled to the inlet channel 21 and can be hydraulically coupled to a high-pressure space by means of the valve element 231. The high-pressure space is hydraulically coupled to the outlet channel 22.

In the closed position of the valve element 231, the valve element 231 rests against a valve seat 234 of a valve body 237. A valve return means is also provided and is arranged and formed such that it presses the valve element 231 into an open position, that is to say at a distance from the valve seat 234, when the forces which act on the valve element by means of an actuating drive 24 are lower than the forces which are created by the pressure of the fluid, here the fuel, and act on the valve element 231 by means of the valve return means. The actuating drive 24 is in the form of a piezo stack.

The actuating drive 24 is preferably coupled to the valve element 231 by means of a transformer which preferably amplifies the stroke of the actuating drive 24. A plug for holding electrical contacts for driving the actuating drive 24 is also preferably provided on the actuating drive 24.

An apparatus 60 for controlling the pump-nozzle apparatus is provided and generates an actuating signal SG for the valve.

In the open position of the valve element 231, fuel is drawn toward the working space 13 via the inlet channel 21 when the piston 11 moves upward, that is to say in the direction away from the nozzle 56. As long as the valve element 231 remains in its open position when the piston 11 subsequently moves downward, that is to say moves in a direction toward the nozzle 56, the fuel in the working space 13 and the outlet channel 22 is forced back into the discharge space 232 and possibly into the inlet channel 21 via the valve.

However, if the valve element 231 is moved to its closed position when the piston 11 moves downward, the fuel in the working space 13 and therefore also in the outlet channel 22 and in the high-pressure space is compressed, as a result of which the pressure in the working space 13, in the high-pressure space and in the outlet channel 22 increases as the downward movement of the piston 11 continues. The force which is created by the hydraulic pressure and acts on the needle shoulder 57 in the direction of an opening movement of the nozzle needle 53 in order to open the nozzle 56 increases in accordance with the increasing pressure in the outlet channel 22. If the pressure in the outlet channel 22 exceeds a value at which the force on the needle shoulder 57 which is created by the hydraulic pressure is greater than the force of the nozzle return means 52 which opposes this, the nozzle needle 53 moves away from the needle seat 54 and thus opens the nozzle 56 for supplying fuel to the cylinder of the internal combustion engine. The nozzle needle 53 then moves into the needle seat 54 again and thus closes the nozzle 56 when the hydraulic pressure in the outlet channel 22 falls below the value at which the force which is created by the hydraulic pressure on the needle shoulder 57 is lower than the force created by the nozzle return means 52. The time at which the pressure falls below this value and at which metering of fuel is therefore terminated can be influenced by moving the valve element 231 from its closed position to an open position.

Moving the valve element from its closed position to its open position produces the hydraulic coupling between the high-pressure space and the discharge space 232 and the inlet channel 21. On account of the high pressure difference which prevails between the fluid in the high-pressure space and the outlet channel 22, and the fluid in the discharge space 232 and the inlet channel 21 during opening, the fuel then flows very rapidly, generally at the speed of sound, from the high-pressure space into the discharge space 232 and further into the inlet channel 21. As a result, the pressure in the high-pressure space and the outflow channel 22 is then quickly reduced to such an extent that the forces acting on the nozzle needle 53 from the nozzle return means 52 lead to the nozzle needle 53 moving into the needle seat 54 and therefore to the nozzle 56 then closing.

Figure 2:
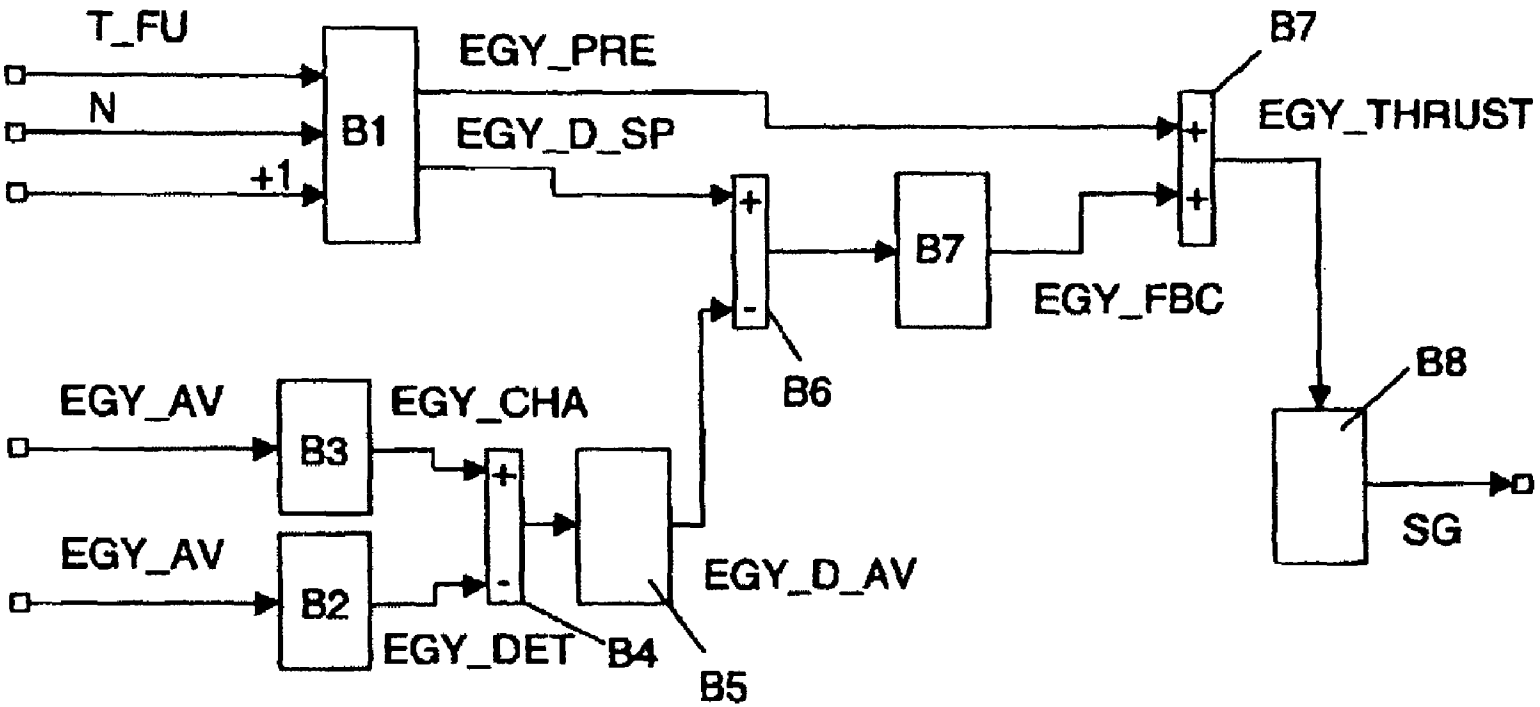
FIG. 2 shows a block diagram for determining an actuating signal SG in the apparatus for controlling the valve.

The procedure for determining an actuating signal SG for charging the piezoelectric actuator of the valve drive 24 is described below with reference to the block diagram from FIG. 2.

At a prescribable first time t1, the valve element 231 is moved into the valve seat from its position remote from the valve seat 234. The prescribable first time t1 is preferably selected such that the piston 11 is in its top dead center and remains there until the valve element 231 meets the valve seat 234 as expected. As a result, the meeting time can be detected in a particularly precise manner. However, the prescribable first time t1 can also be selected such that the piston 11 has left its top dead center until the valve element 231 meets the valve seat 234 as expected.

In a block B1, a pilot control value EG_PRE of the electrical power to be supplied is first determined as a function of a fuel temperature T_FU and/or a rotational speed N and the prescribable time t1. The pilot control value EGY_PRE of the electrical power to be supplied is determined, for example, by means of a characteristic diagram whose characteristic values have been determined in advance by experiments.

Furthermore, a setpoint value EGY_D_SP of a differential electrical power is determined in block B1. The setpoint value EGY_D_SP of the differential electrical power is characteristic of the valve seating force which is exerted on the valve seat 234 of the valve body 237 by the valve element 231 when said valve element 231 is in contact with the valve seat 234. The setpoint value EGY_D_SP of the differential electrical power is determined in block B1 as a function of the fuel temperature T_FU, the rotational speed N and/or the prescribable first time t1. This may be performed, for example, by means of a corresponding characteristic diagram too.

In a block B2, is supplied as a function of actual values EGY_AV of the electrical power which is supplied to the piezoelectric actuator during the charging process. Furthermore, the time t2 at which the valve element 231 meets the valve seat is determined in block B2. This may be done, for example, by evaluating actual values V_AV of the piezoelectric voltage or corresponding variables which characterize said piezoelectric voltage, for example the actual current through the piezoelectric actuator or the charge or electrical power supplied to the piezoelectric actuator. When the valve element 231 meets the valve seat, a characteristic profile of these variables is produced and this can be used to identify the time t2 at which the valve element 231 meets the valve seat. An actual value EGY_DET of the electrical power supplied when the valve element 231 enters the valve seat 234 is then also determined in block B2 on the basis of the determined time t2 at which the valve element 231 enters the valve seat 234 and the actual value EGY_AV of the supplied power which is associated with this time.

In a block B3, the actual values EGY_AV of the supplied electrical power are likewise read-in and the actual value EGY_AV at the end of the charging process of the piezoelectric actuator is associated with an actual value EGY_CHA of the electrical power supplied when the charging process is concluded. Conclusion of the charging process may be identified, for example, by the actual values EGY_AV of the supplied electrical power reaching a maximum or else by a further control function for the pump-nozzle apparatus receiving corresponding information.

In a block B4, the difference between the actual value EGY_CHA of the electrical power supplied when the charging process is concluded and the actual value EGY_DET of the electrical power supplied when the valve element 231 enters the valve seat 234 is then determined and passed on to a block B5 which comprises a low-pass filter and provides an actual value EGY_D_AV of the differential electrical power at its output.

In a block B6, the difference between the setpoint value EGY_D_SP and the actual value EGY_D_AV of the differential electrical power is formed. In a more simple embodiment, the actual value EGY_D_AV of the differential electrical power can also be determined directly, without the low-pass filter of block B5.

The output of block B6 is connected to the input end of a block B7 which comprises a controller which is preferably in the form of a PI controller. The actuating variable of the controller, which in this exemplary embodiment is a control value EGY_FBC of the electrical power to be supplied, is then supplied to a block B7 in which a desired electrical power EGY_THRUST which is to be supplied to the piezoelectric actuator is determined by adding the control value EGY_FBC and the pilot control value EGY_PRE of the electrical power to be supplied.

The value EGY_THRUST of the desired electrical power to be supplied is supplied to a block B8 in which a corresponding actuating signal SG for driving the valve drive 24, which is in the form of a piezoelectric actuator, is generated. The actuating signal SG is preferably a pulse-width-modulated signal and the desired electrical power EGY_THURST to be supplied is preferably divided into a prescribed number of partial quantities of power which are in each case supplied to the piezoelectric actuator in one period of the pulse-width-modulated signal. The block B8 also preferably comprises a further subordinate controller which controls the actual supply of electrical power to the piezoelectric actuator, with the actuating variable being the respective pulse width of the actuating signal SG. For this purpose, the control variable used may be, for example, the respective actual charge or the actual values V_AV of the piezoelectric voltage or the actual values EGY_AV of the supplied electrical power.

If the actuating signal SG for a charging process following a second prescribable time is to be determined, which time can also be selected such that the piston 11 has left its top dead center until the valve element 231 meets the valve seat 234 as expected, the control value EGY_FBC of the electrical power to be supplied is preferably taken over by a charging process which previously took place following the first prescribable time t1. Then, only the pilot control value EGY_PRE of the electrical power to be supplied is recalculated. This has the advantage of reducing the amount of calculation and that, when the prescribable first time t1 is selected such that the piston 11 is in its top dead center and remains there until the valve element 231 meets the valve seat 234 as expected, the valve seating force is then set in an extremely precise manner for the prescribable second time too. In this case, the pilot control value EGY_PRE for the second prescribable time is then also determined as a function of the second time.

Figure 3:
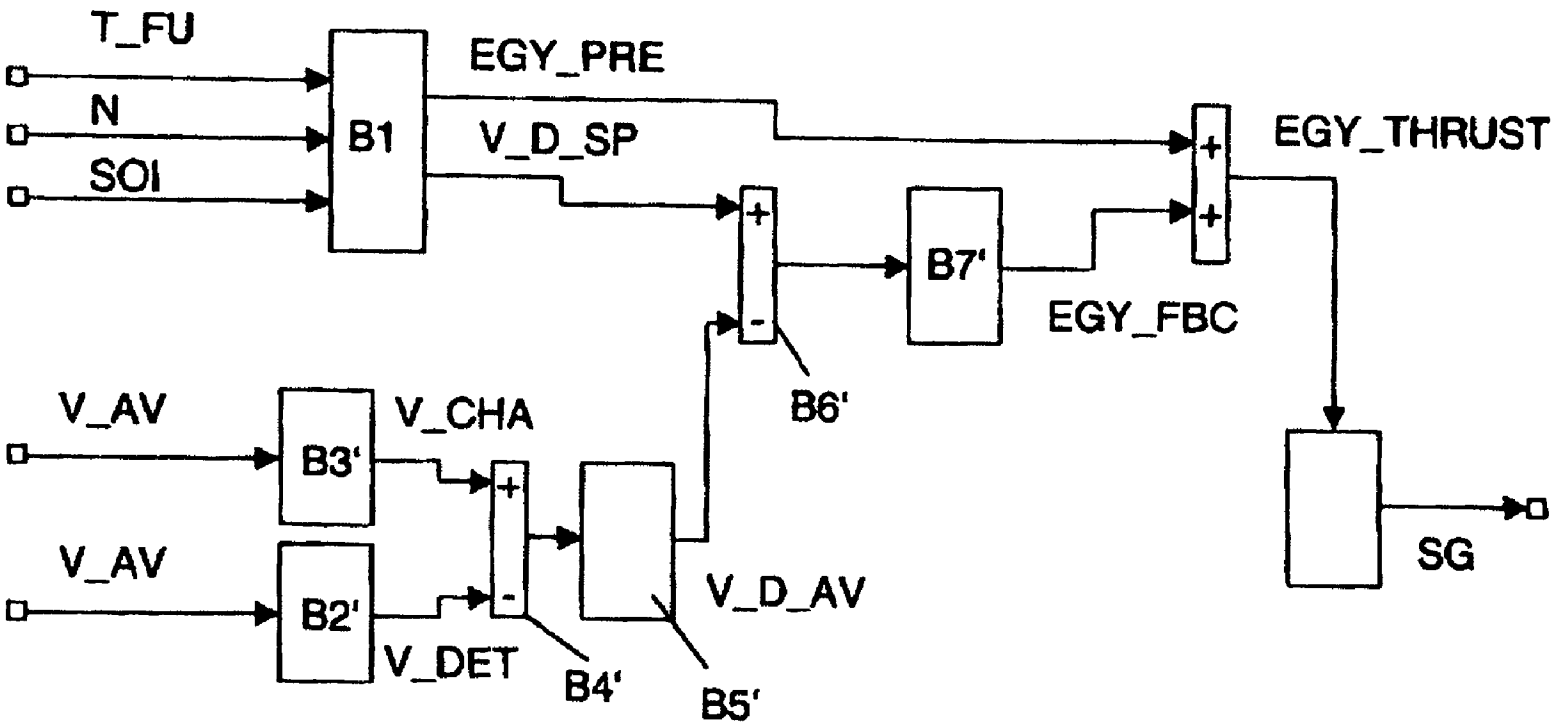
FIG. 3 shows a further block diagram for determining the actuating signal SG.

FIG. 3 shows an alternative embodiment of the block diagram according to FIG. 1. Only the differences are explained below. A block B1' differs from the block B1 in that, instead of the setpoint value EGY_D_SP of the differential electrical power, a setpoint value V_D_SP of a differential voltage is determined, this setpoint value of the differential voltage being determined in a corresponding manner as a function of the fuel temperature T_FU and/or the rotational speed N of the crankshaft of the internal combustion engine and/or the prescribable first time t1.

In a block B2', a piezoelectric voltage V_DET which is produced when the valve element 231 enters the valve seat 234 is determined by corresponding association with an actual value V_D_AV of the piezoelectric voltage. In a block B3', in contrast to block B3, a piezoelectric voltage V_CHA which is produced when the charging process is concluded is determined, to be precise as a function of actual values V_AV of the piezoelectric voltage.

In a block B4', the difference between the piezoelectric voltage V_CHA which is produced when the charging process is concluded and the piezoelectric voltage V_DET which is produced when the valve element 231 enters the valve seat 234 is formed and supplied to the block B5' which, like block B5, comprises a low-pass filter and provides an actual value V_DAV of the differential voltage at its output.

In a block B6', the difference between the setpoint value V_D_SP and the actual value V_D_AV of the differential voltage is formed and passed on to a controller which is formed in block B7' and corresponds to block B7. In further alternative refinements, other variables which are characteristic of the electrical power which is to be supplied to the piezoelectric actuator, for example the electrical charge which is to be supplied to the piezoelectric actuator, can also be supplied to the controller.

Figures 4A, 4B, 4C, 4D:
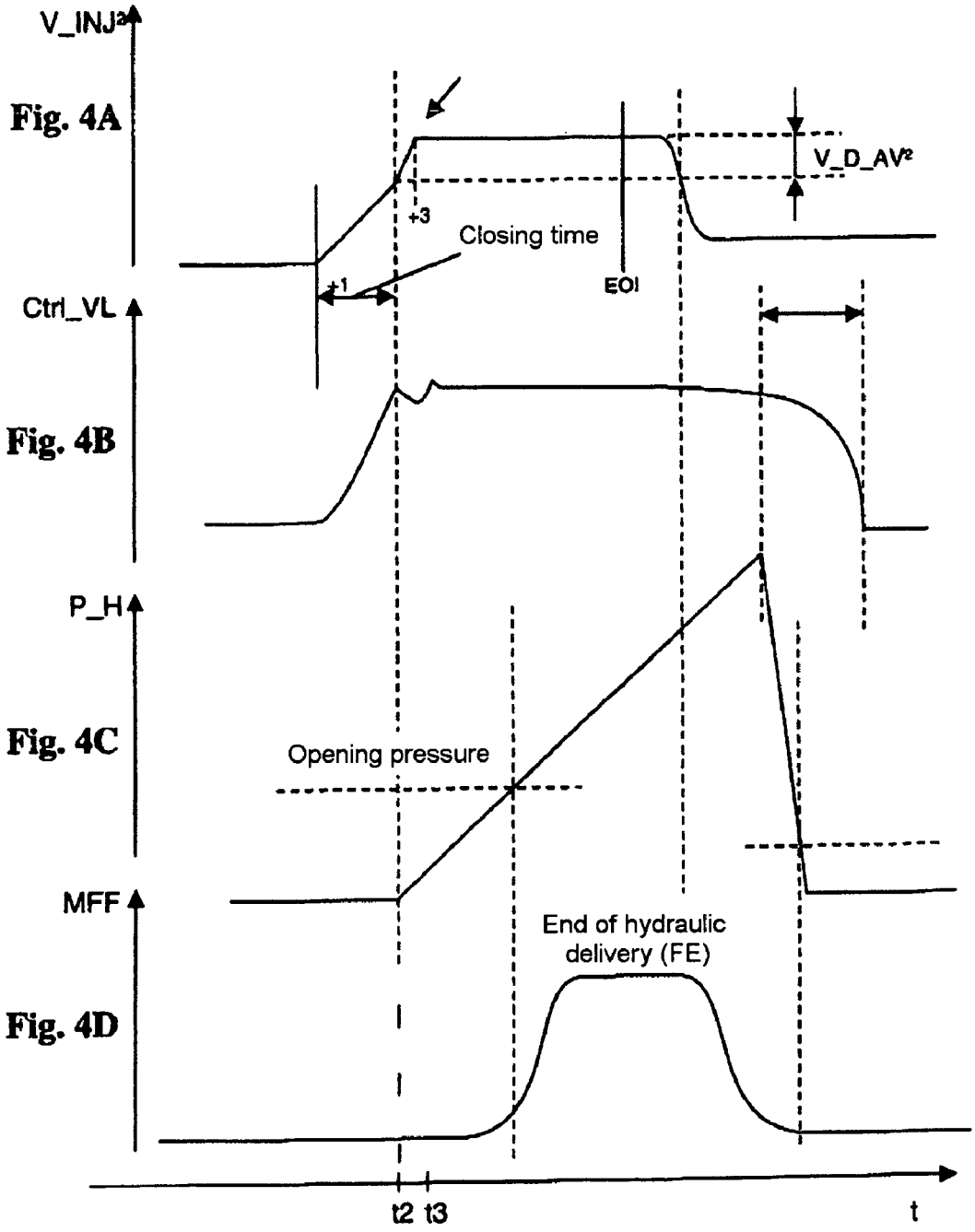
FIGS. 4*a* to 4*d* show time profiles of the piezoelectric voltage V_AV, of the stroke CTRL_VL of the valve element 231, of the pressure P_H in the working space 13 of the pump, and the injection quantity MFF.

FIGS. 4*a* to 4*d* show profiles plotted against time t. FIG. 4*a* shows the time profile of the square of the piezoelectric voltage V_INJ. FIG. 4*b* shows the stroke CTRL_VL of the valve element 231. FIG. 4*c* shows the profile of the pressure P_H in the working space 13 of the pump. FIG. 4*d* shows the time profile of the quantity of fuel MFF which is metered with the pump-nozzle apparatus. t1 is the prescribable first time, but it may also be the second prescribable time. t2 is the time at which the valve element 231 meets the valve seat 234, and t3 is the time which indicates the end of the charging process. However, the control value EGY_FBC of the electrical power to be supplied is preferably determined during a time period during which the piston 11 is in its top dead center. In this case, the profile of the pressure P_H in the working space of the pump over the entire period of time illustrated remains at the level of time t1, and equally no fuel is then requested in this case.

What is claimed is:

1. A method for controlling a valve having a valve drive, which is in the form of a piezoelectric actuator, comprising a valve element, a valve body and a valve seat, the method comprising the steps of:

moving the valve element into the valve seat from a position remote from the valve seat by means of a charging process of the piezoelectric actuator at a prescribable first time, determining a first value which is characteristic of the electrical power which is supplied to the piezoelectric actuator when the valve element meets the valve seat, determining a second value which is characteristic of the electrical power which is supplied to the piezoelectric actuator when the charging process of the piezoelectric actuator is concluded, determining an actual difference value from the difference between the second value and the first value, supplying a difference between a setpoint difference value, which can be prescribed, and the actual difference value to a controller, and determining an actuating signal for charging the piezoelectric actuator as a function of the actuating variable of the controller.

2. A method according to claim 1, wherein the actuating signal for charging the piezoelectric actuator is determined as a function of a pilot control value.

3. A method according to claim 1, wherein the setpoint difference value is determined as a function of a fuel temperature and/or a rotational speed and/or the prescribable first time.

4. A method according to claim 2, wherein the pilot control value is determined as a function of a fuel temperature and/or a rotational speed and/or the prescribable first time.

5. A method according to claim 1, wherein the controller is a controller with a proportional component and an integral component.

6. A method according to claim 1, wherein the actual difference value is low-pass-filtered before the difference from the setpoint difference value is formed.

7. A method according to claim 1, wherein the first value is an actual value of the electrical power supplied when the valve element enters the valve seat, the second value is an actual value of the electrical power supplied when the charging process is concluded, the actual difference value is an actual value of the differential electrical power which is supplied to the piezoelectric actuator, and the setpoint difference value is a setpoint value of the differential electrical power.

8. A method according to claim 1, wherein the first value is an actual value of the piezoelectric voltage which is produced when the valve element enters the valve seat, the second value is an actual value of the piezoelectric voltage which is produced when the charging process is concluded, the actual difference value is an actual value of the differential voltage, and the setpoint difference value is a setpoint value of the differential voltage.

9. A method for controlling a pump-nozzle apparatus, comprising a pump which has a piston and a working space, a control unit which comprises an outlet channel, which is hydraulically coupled to the working space, and a valve, having a valve drive, which is in the form of a piezoelectric actuator, a valve element, a valve body, a valve seat and a discharge space which is hydraulically decoupled from the outlet channel when the valve element rests against the valve seat and which is otherwise hydraulically coupled to the outlet channel, the method comprising the step of controlling the valve using a method according to claim 1.

10. A method according to claim 9, wherein the prescribable first time is selected such that the piston is in its top dead center and remains there until the valve element meets the valve seat as expected, and in that the actuating variable determined in this way is used to determine the actuating signal when the valve element is moved into the valve seat from a position remote from the valve seat by means of a charging process of the piezoelectric actuator at a second prescribable time, it also being possible to select the second prescribable time such that the piston has left its top dead center until the valve element meets the valve seat as expected.

11. An apparatus for controlling a valve comprising a valve drive, which is in the form of a piezoelectric actuator, comprising a valve element, a valve body and a valve seat, the apparatus comprising means for moving the valve element into the valve seat from a position remote from the valve seat by means of a charging process of the piezoelectric actuator at a prescribable first time, for determining a first value which is characteristic of the electrical power which is supplied to the piezoelectric actuator when the valve element meets the valve seat, for determining a second value which is characteristic of the electrical power which is supplied to the piezoelectric actuator when the charging process of the piezoelectric actuator is concluded, for determining an actual difference value from the difference between the second value and the first value, for supplying a difference between a setpoint difference value, which can be prescribed, and the actual difference value to a controller, and for determining an actuating signal for charging the piezoelectric actuator as a function of the actuating variable of the controller.

12. An apparatus for controlling a pump-nozzle apparatus, comprising a pump which has a piston and a working space, a control unit which comprises an outlet channel, which is hydraulically coupled to the working space, and a valve, having a valve drive, which is in the form of a piezoelectric actuator, a valve element, a valve body, a valve seat and a discharge space which is hydraulically decoupled from the outlet channel when the valve element rests against the valve seat and which is otherwise hydraulically coupled to the outlet channel, and an apparatus for controlling a valve according to claim 11.

13. A method for controlling a valve comprising a piezoelectric actuator comprising a valve element, a valve body and a valve seat, the method comprising the steps of:

charging the piezoelectric actuator at a prescribable first time to move the valve element into the valve seat from a position remote from the valve seat, determining a first value which is characteristic of an electrical power which is supplied to the piezoelectric actuator when the valve element meets the valve seat, determining a second value which is characteristic of an electrical power which is supplied to the piezoelectric actuator when the charging process of the piezoelectric actuator is concluded, determining an actual difference value between the second value and the first value, supplying a difference between a setpoint difference value and the actual difference value to a controller, and determining an actuating signal for charging the piezoelectric actuator as a function of the actuating variable of the controller.

14. A method according to claim 12, wherein the actuating signal for charging the piezoelectric actuator is determined as a function of a pilot control value.

15. A method according to claim 13, wherein the setpoint difference value is determined as a function of a fuel temperature and/or a rotational speed and/or the prescribable first time.

16. A method according to claim 14, wherein the pilot control value is determined as a function of a fuel temperature and/or a rotational speed and/or the prescribable first time.

17. A method according to claim 13, wherein the controller is a controller with a proportional component and an integral component.

18. A method according to claim 13, wherein the actual difference value is low-pass-filtered before the difference from the setpoint difference value is formed.

19. A method according to claim 13, wherein the first value is an actual value of the electrical power supplied when the valve element enters the valve seat, the second value is an actual value of the electrical power supplied when the charging process is concluded, the actual difference value is an actual value of the differential electrical power which is supplied to the piezoelectric actuator, and the setpoint difference value is a setpoint value of the differential electrical power.

20. A method according to claim 13, wherein the first value is an actual value of the piezoelectric voltage which is produced when the valve element enters the valve seat, the second value is an actual value of the piezoelectric voltage which is produced when the charging process is concluded, the actual difference value is an actual value of the differential voltage, and the setpoint difference value is a setpoint value of the differential voltage.

* * * * *